US007094115B2

(12) United States Patent
Noro et al.

(10) Patent No.: US 7,094,115 B2
(45) Date of Patent: Aug. 22, 2006

(54) FEMALE TERMINAL FITTING

(75) Inventors: Yutaka Noro, Yokkaichi (JP); Ryotaro Ishikawa, Yokkaichi (JP); Hajime Kawase, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 11/174,705

(22) Filed: Jul. 5, 2005

(65) Prior Publication Data

US 2006/0009090 A1 Jan. 12, 2006

(30) Foreign Application Priority Data

Jul. 7, 2004 (JP) ..... 2004-201049

(51) Int. Cl.
*H01R 13/11* (2006.01)

(52) U.S. Cl. ..... 439/852; 439/851

(58) Field of Classification Search ..... 439/851, 439/852, 258, 259

See application file for complete search history.

(56) References Cited

U.S. PATENT DOCUMENTS 4,209,220 A * 6/1980 Szablowski ..... 439/862
4,699,444 A * 10/1987 Isohata ..... 439/839
4,708,416 A * 11/1987 Awano ..... 439/851
4,838,816 A * 6/1989 Matsusaka et al. ..... 439/861
5,271,741 A * 12/1993 Saito et al. ..... 439/843
5,281,178 A * 1/1994 Biscorner ..... 439/845
5,336,540 A 8/1994 Kato et al.
5,620,347 A * 4/1997 Sawada ..... 439/851
5,649,842 A * 7/1997 Ohsumi ..... 439/858
5,839,925 A * 11/1998 Simmons ..... 439/852
5,897,405 A * 4/1999 Endo ..... 439/852
5,941,741 A * 8/1999 Dobbelaere et al. ..... 439/852

* cited by examiner

*Primary Examiner*—Tulsidas C. Patel
*Assistant Examiner*—Vladimir Imas
(74) *Attorney, Agent, or Firm*—Gerald E. Hespos; Anthony J. Casella

(57) ABSTRACT

A female terminal fitting (20) has an approximately tubular connection portion (22) with an open front end for receiving a tab (14) of a male terminal fitting (10). Concavities (30) extend longitudinally in the connection portion (22) at positions opposed to side surfaces of the tab (14). The concavities (30) enable the outside width (W) of the connection portion (22) to be small while securing a large clearance (C) outward from the side surfaces of the tab (14). The concavities (30) do not significantly decrease the strength of the entire connection portion (22). Additionally, the large clearance (C) avoids the need for highly accurate manufacturing.

7 Claims, 8 Drawing Sheets

FEMALE TERMINAL FITTING

BACKGROUND OF THE INVENTION

1. Field of the Invention

The invention relates to a female terminal fitting.

2. Description of the Related Art

U.S. Pat. No. 5,336,540 discloses a female terminal fitting that is fixed to an end of an electric wire. The female terminal fitting has a box-shaped connection portion with an open front end for receiving the tab of a male terminal fitting. An elastic contact piece is provided inside the female terminal fitting and elastically contacts the tab that has been inserted into the open front of the connection portion. Thus, an electrical connection is made between the tab of the male terminal fitting and the elastic contact piece of the female terminal fitting.

There is a growing demand for miniature terminal fittings. However, the tab of the male terminal fitting must be sufficiently wide to achieve a reliable electrical connection between the male and female terminal fittings. Thus, options for miniaturization appear to reside in the connection portion of the female terminal fitting into which the tab is inserted.

A thinner material could be used for the female terminal fitting. However, there is a fear that the strength of the female terminal fitting will decrease too much.

The clearance between the side surfaces of the connection portion of the female terminal fitting and the side surfaces of the tab ensure a reliable insertion of the tab into the connection portion. Attempts have been made to reduce the clearance to achieve miniaturization. However, a smaller clearance requires the male and female terminal fittings to be manufactured at high accuracy, thus reducing productivity.

The invention has been completed in view of the above-described situation. Accordingly, an object of this invention is to provide a compact female terminal fitting without deteriorating the strength and productivity thereof.

SUMMARY OF THE INVENTION

The invention relates to a female terminal fitting having an approximately box-shaped connection portion with opposite front and rear ends and opposite side surfaces. A tab of a mating male terminal fitting can be inserted into the open front end of the connection portion to achieve electrical connection between the male and female terminal fittings. At least one concavity is formed on a side surface of the connection portion opposed to a widthwise side surface of the tab. Two opposed concavities preferably are formed in the connection portion to oppose the opposite side surfaces of the tab.

The concavities preferably are formed by striking inner surfaces of the connection portion.

The concavities formed on the side surfaces of the connection portion enable a connection portion that has a narrow external width, while also having large clearance outward from the side surfaces of the tab. The concavities are formed only on part of side surfaces of the connection portion. Thus, a decrease in the strength of the entire connection portion can be minimized. The large clearance avoids the need for a higher accuracy in manufacturing both male and female terminal fittings. Thus, productivity will not deteriorate.

The above-described female terminal fitting is made compact without deteriorating the strength and productivity.

The concavity is formed by striking the inner surface of the side plate. Thus the female terminal fitting can be formed in the course of a series of processes for manufacturing the female terminal fitting by press molding.

DETAILED DESCRIPTION OF THE PREFERRED EMBODIMENTS

Figure 1:
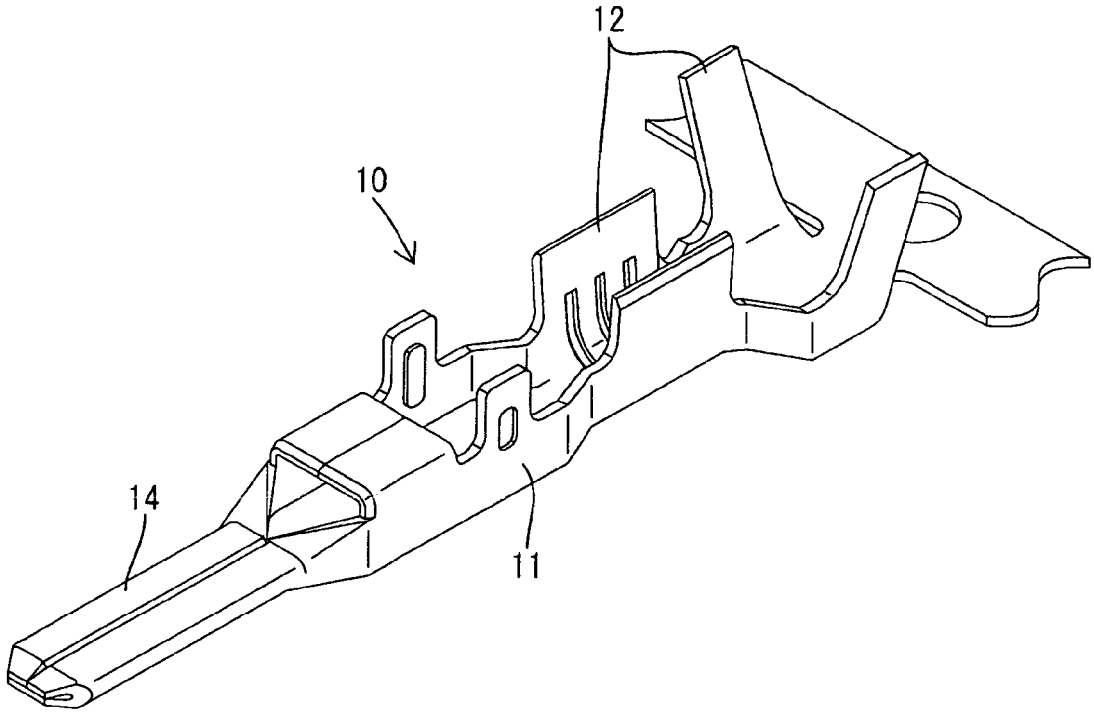
FIG. 1 is a perspective view of a male terminal fitting that mates a female terminal fitting of the present invention.
Figure 2:
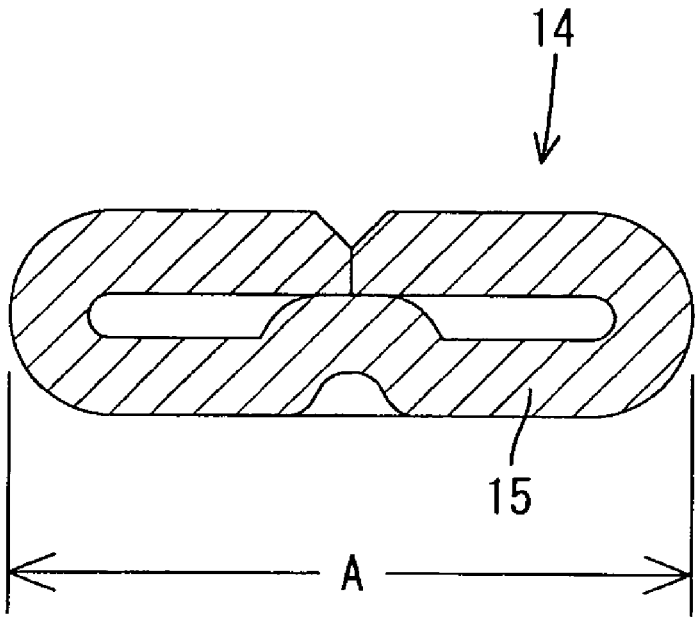
FIG. 2 is a transverse sectional view showing a tab.

A metal fitting according to the invention has a male terminal fitting 10 and a female terminal fitting 20, as shown in FIGS. 1–8A. The male terminal fitting 10 is formed by press working a metal plate having a high electrical conductivity. As shown in FIGS. 1 and 2, the male terminal fitting 10 has opposite front and rear ends and a body 11 between the ends. A barrel 12 is disposed rearward from the body 11 and is configured to be crimped to an end of an electric wire 40. A tab 14 is disposed forward of the body 11 and is dimensioned for connection with the female terminal fitting 20.

As shown in FIG. 2, the tab 14 is formed from a substrate 15, and half of the left and right sides of the substrate 15 are folded up to form a double-plate construction of width A. A front end of the tab 14 is tapered to guide more rearward portions of the tab 14 into the female terminal fitting 20.

Figure 3:
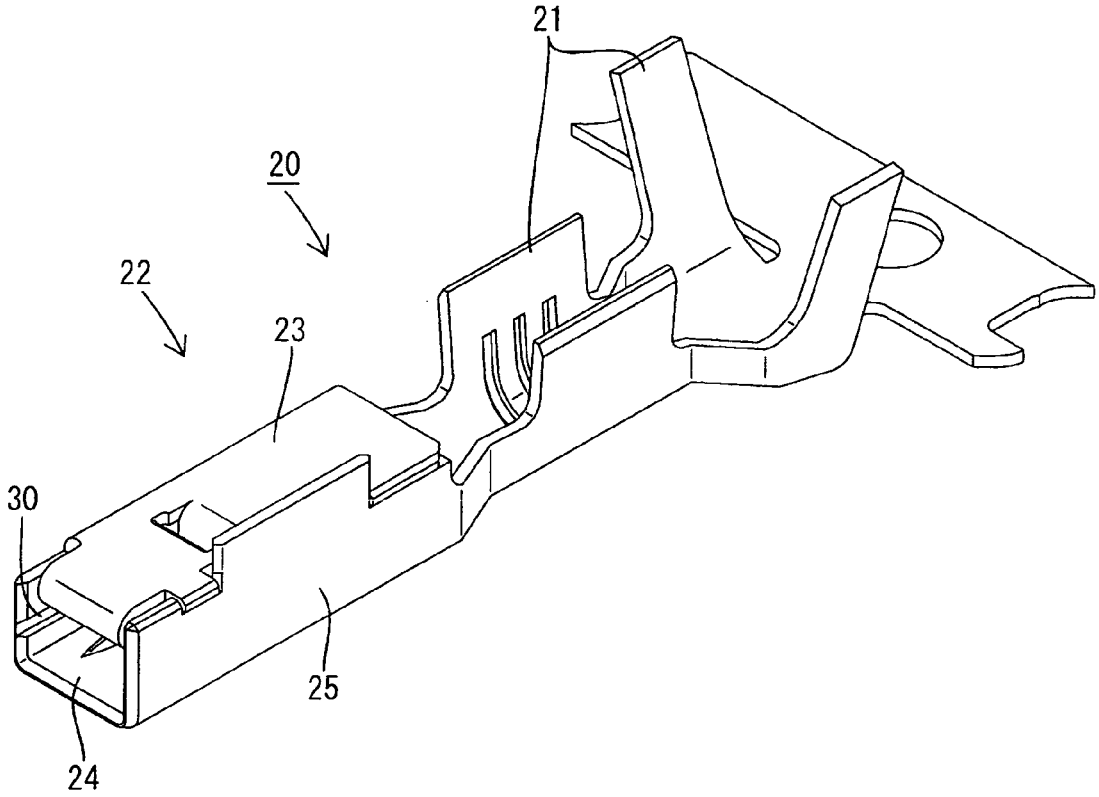
FIG. 3 is a perspective view of the female terminal fitting of the invention.
Figure 4:
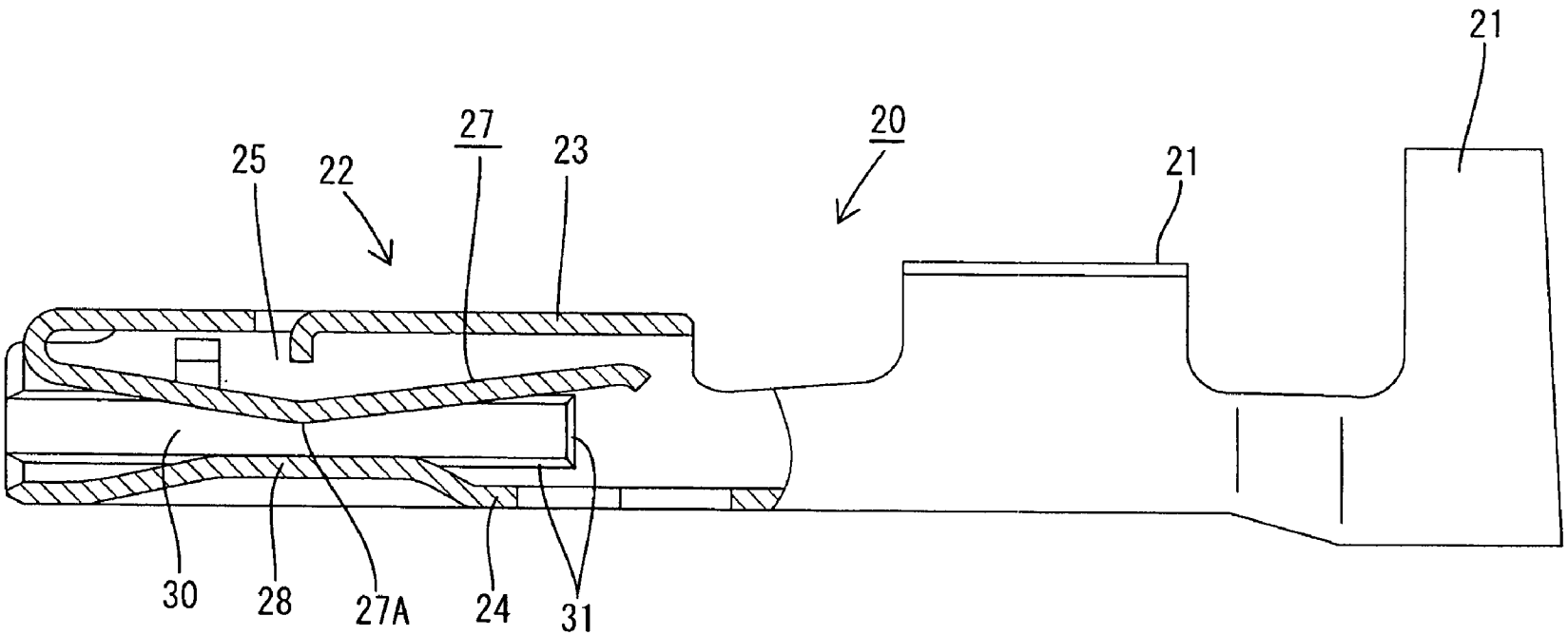
FIG. 4 is a partly cut-away side view showing the female terminal fitting of FIG. 3.
Figure 5:
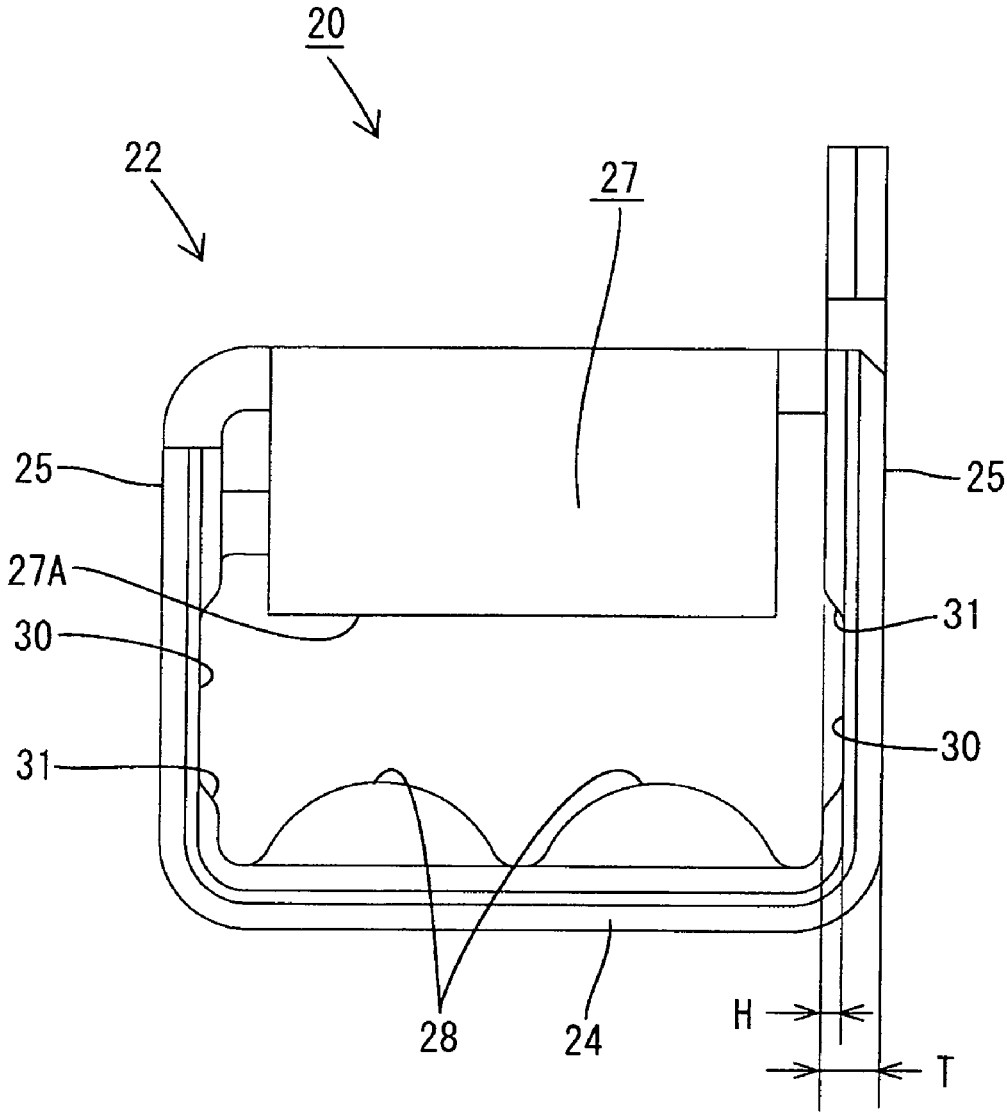
FIG. 5 is a front view showing a connection portion of the female terminal fitting.

The female terminal fitting 20 is formed into the configuration shown in FIGS. 3 through 5 by press working a metal plate having a high electrical conductivity. The female terminal fitting 10 has opposite front and rear ends. A barrel 21 is formed at the rear end and is configured to be crimped to the end of a wire 40. A connection portion 22 is disposed forward of the barrel 21 and is configured to receive the tab 14 of the mating male terminal fitting 10.

The connection portion 22 is generally box-shaped, and hence defines a substantially rectangular tube with open front and rear ends. The substantially rectangular tube of the connection portion 22 has a ceiling plate 23, a bottom plate 24 opposed to the ceiling plate 23, and opposed left and right side plates 25 that extend between the ceiling plate 23 and the bottom plate 24. The connection portion 22 is relatively short in the width direction of the female terminal fitting 20 and longer in the longitudinal direction thereof. More particularly, the connection portion 22 is slightly longer than the tab 14 of the male terminal fitting 10 and slightly wider than the width A of the tab 14.

Figure 7:
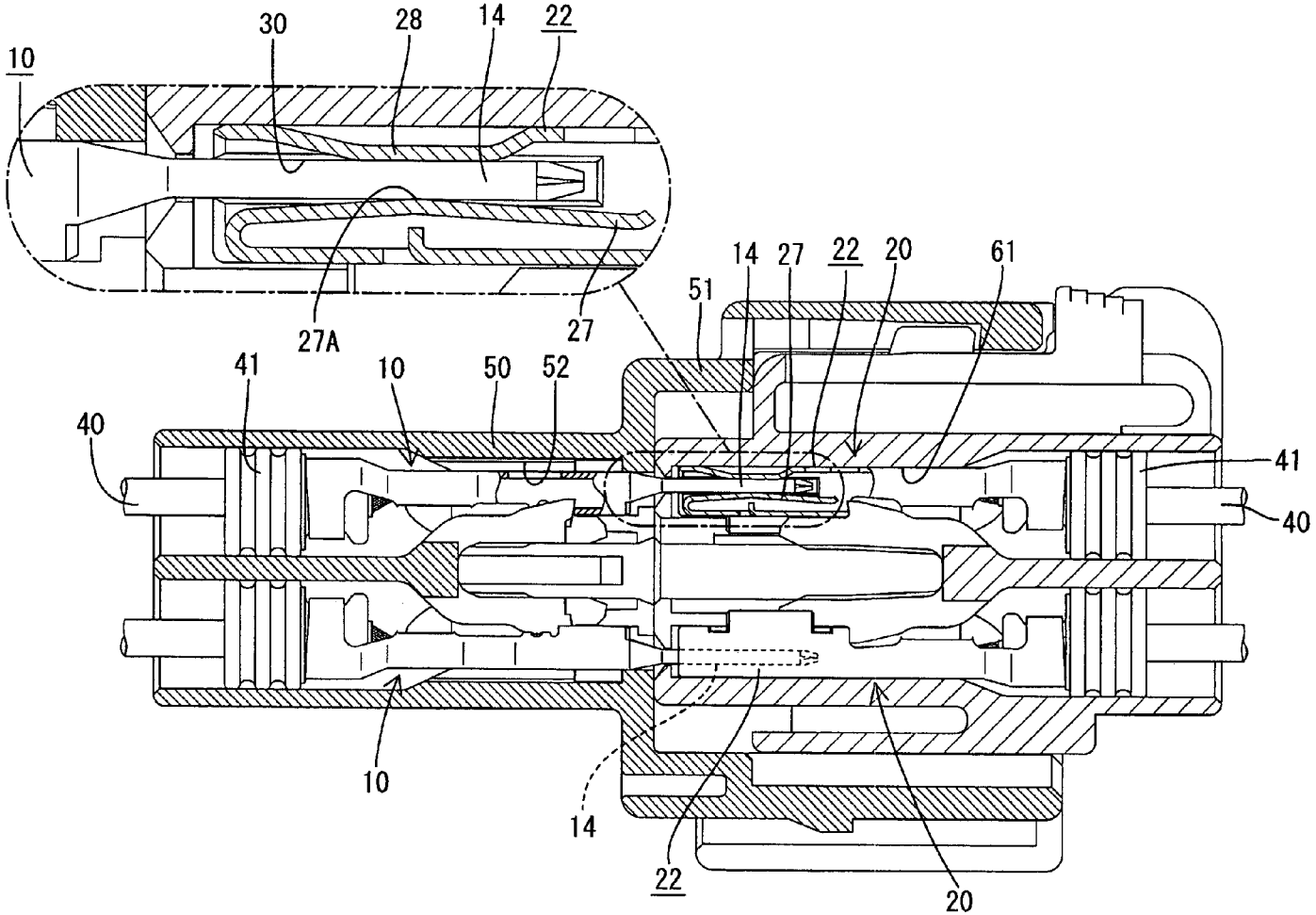
FIG. 7 is a vertical sectional view showing complete fitting between the male housing and the female housing.
Figure 8A:
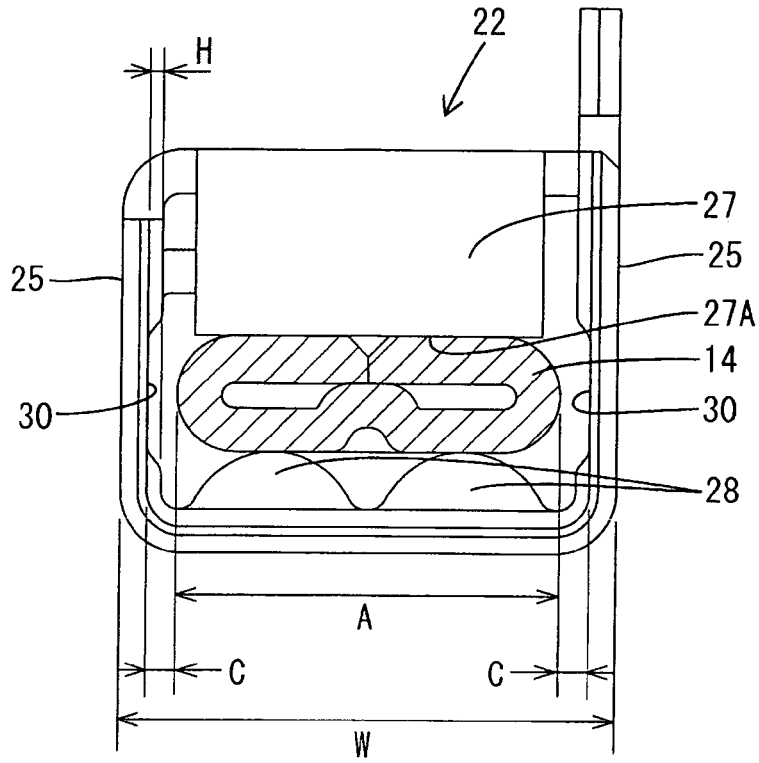
FIG. 8A is a partly cut-away front view of to-be-fit portions of the male and female terminal fittings.

An elastic contact piece 27 is folded back from a front end of the ceiling plate 23 and has a generally V-shape with an apex 27A. As shown in FIG. 5, two convexities 28 are formed to extend longitudinally in female terminal fitting 20 by striking the bottom plate 24 in. As shown in FIGS. 7 and 8A, the tab 14 of the male terminal fitting 10 can be inserted into the open front end of the connection portion 22 of the female terminal fitting 20 and into the space between the elastic contact piece 27 and the convexities 28. The tab 14 has a thickness sufficient to deform the elastic contact piece 27 elastically when the tab 14 is inserted into the connection portion 22 a predetermined amount. Thus, the tab 14 is sandwiched elastically between the apex 27A of the elastic contact piece 27 and the convexities 28 due to a restoring elastic force of the elastic contact piece 27.

Concavities 30 are formed on inner surfaces of the left and right side plates 25 of the connection portion 22 of the female terminal fitting 20 and extend along the longitudinal direction of the female terminal fitting 20. More specifically, as shown in FIGS. 4 and 8A, the concavities 30 are at vertical positions on the inner surfaces of the left and right side plates 25 to oppose widthwise side surfaces of the tab 14 inserted into the connection portion 22. Additionally, the concavities 30 have open front ends at the front end of the connection portion 22 and extend longitudinally from the front end of the connection portion 22 for a distance almost equal to the length of the tab 14.

Each concavity 30 has a height measured between the ceiling plate 23 and the bottom plate 24 that is slightly larger than the thickness of the tab 14. As shown in FIG. 5, the depth H of the concavity 30 is between about 20% and 50% of the thickness T of the side plate 25, and preferably about 40% of the thickness T of the side plate 25. For example, the side plate 25 may have a thickness T of about 0.25 mm and the concavity 30 may have a depth H of about 0.1 mm. The concavities do not deform the outer surfaces of the side plates 25. Thus, the outer surfaces of the side plates 25 remain substantially flat and planar.

Portions of each concavity 30 spaced from the tapered surfaces define a clearance C outward from both side surfaces of the tab 14 inserted into the connection portion 22, as shown in FIG. 8A.

Figure 6:
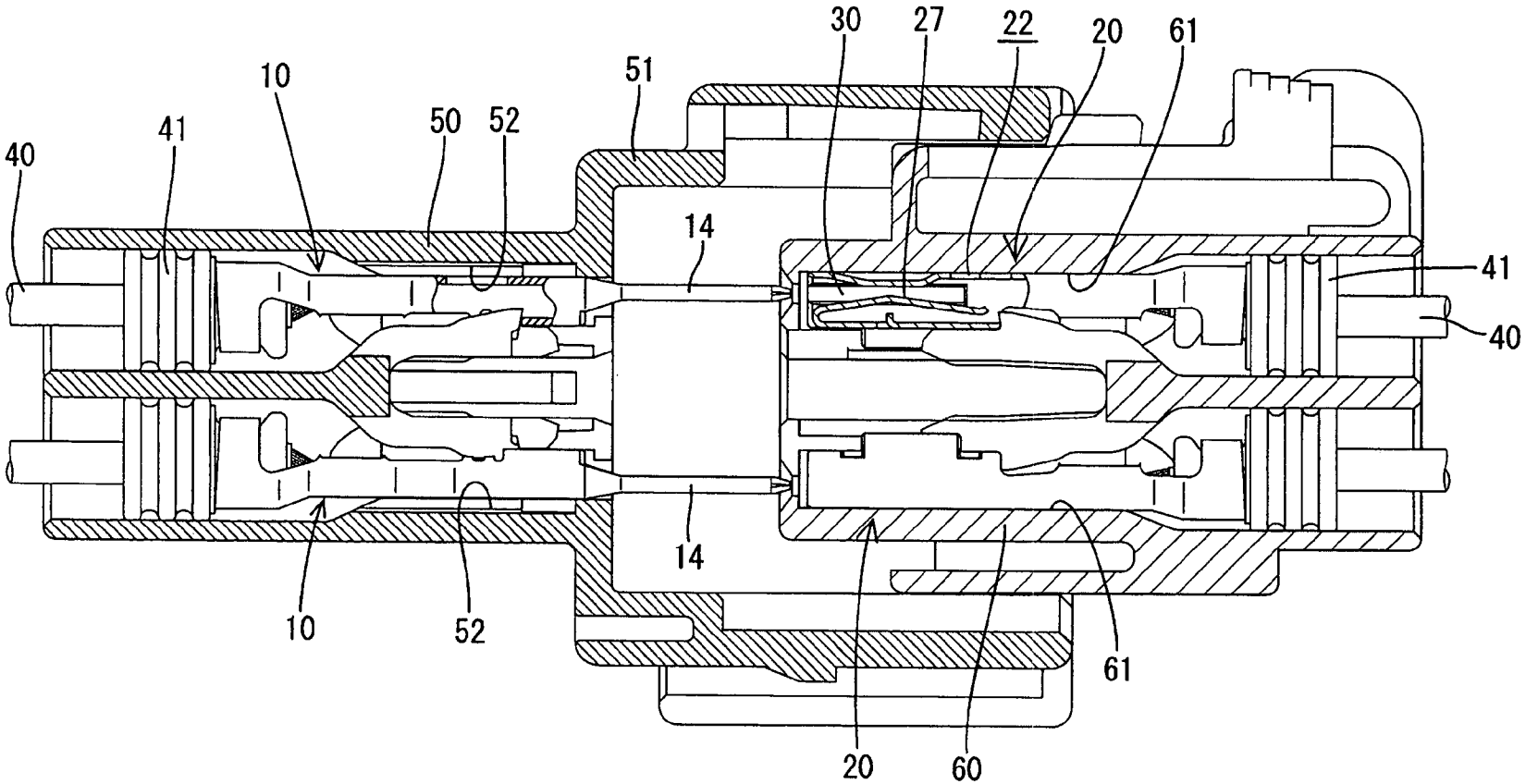
FIG. 6 is a vertical sectional view showing an initial state of filling between a male housing and a female housing.

The male and female terminal fittings 10 and 20 are crimped to the ends of the electric wires 40, together with a rubber plug 41. The male terminal fittings 10 then are inserted into cavities 52 of a male housing 50 so that the tabs 14 project forward into a hood 51 of the male housing 50, as shown in FIG. 6. The female terminal fittings 20 similarly are accommodated inside cavities 61 of a female housing 60.

An operation of fitting the male housing 50 in the female housing 60 proceeds from the state shown in FIG. 6. More particularly, the tabs 14 of the male terminal fittings 10 move into the openings at the front ends of the respective connection portions 22 of the female terminal fittings 20. Each tab 14 then moves into the space between the elastic contact piece 27 and the convexities 28 and elastically deforms the elastic contact piece 27. The male and female housings 50 and 60 lock together at a predetermined insertion position, as shown in FIG. 7. In this position, each tab 14 is sandwiched elastically between the apex 27A of the respective elastic contact piece 27 and the convexities 28 due to the restoring elastic force of the elastic contact piece 27. Thus, an electrical connection is made between the tab 14 and the connection portion 22 to electrically connect the respective pairs of male and female terminal fittings 10 and 20.

The clearances C between the side surfaces of the tab 14 and the respective side plates 25 of the connection portion 22 enable the tab 14 to be inserted into the connection portion 22 smoothly and reliably.

The predetermined clearances C between the side surfaces of the tab 14 and the female terminal fitting 20 are obtained by the concavities 30 formed on the inner surfaces of the left and right side plates 25, as shown in FIG. 8A.

Figure 8B:
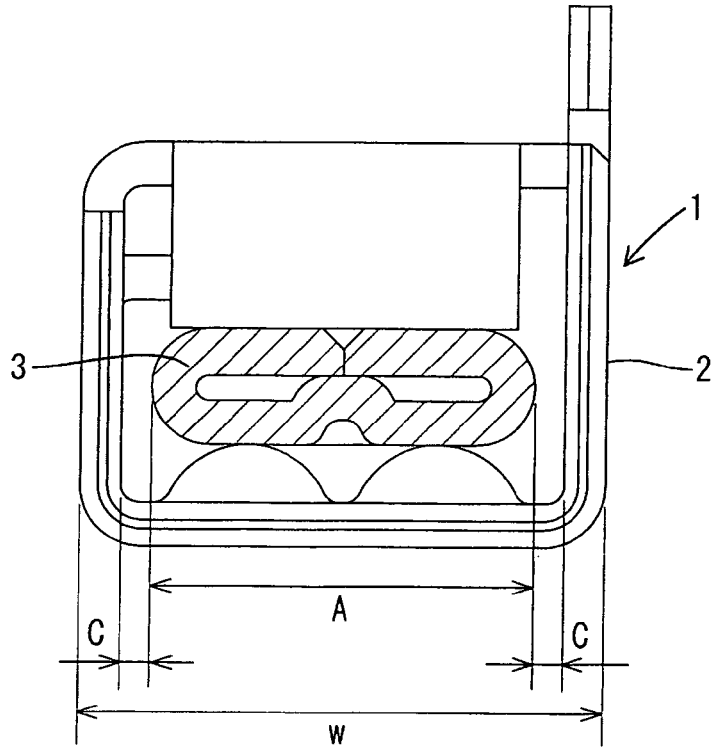
FIG. 8B is a partly cut-away front view of to-be-fitted portions of male and female terminal fittings of a comparison example.

In a comparison example shown in FIG. 8B, the inner surface of a side plate 2 of a connection portion 1 has a uniform thickness equal to the thickness at other locations on the connection portion 22 and inner surfaces of the side plates 2 are flat. In this construction, a tab 3 is inserted into the connection portion 1 and has a width A equal to the width A of the tab 14 of FIG. 2. As a result, the opposite outer surfaces of the connection portion 1 define a width w if equal clearances C are formed at the sides of the connection portion 1.

In contrast, the concavities 30 are formed on the inner surfaces of the left and right side plates 25. Thus, the width W between the outer surfaces of the side plates 25 at all locations on the connection portion 22 is less than the width w of the connection portion 1 of the comparison example by double the depth H of each concavity 30, as shown by the following equation:

$$W = w - (\text{depth } H \times 2)$$

Thus, it is possible to make the width W of the connection portion 22 small and to secure the large clearance C outward from both side surfaces of the tab 14.

The concavities 30 are formed only in regions of the left and right side plates 25 of the connection portion 22 opposed to the left and right side surfaces of the tab 14. Therefore, the strength of the entire connection portion 22 is decreased only a small amount.

Large clearances C are secured between the tab 14 and the side plates 25 of the connection portion 22. As a result, highly accurate dimensional tolerances are not required to manufacture the male and female terminal fittings 10 and 20, and there is no decrease in productivity.

Consequently the female terminal fitting 20 can be made compact without deteriorating strength and manufacturing productivity.

The concavities 30 are formed by striking inner surfaces of the side plates 25. Thus the female terminal fitting 20 can be formed in the course of a series of press molding processes for manufacturing the female terminal fitting 20. Therefore the method of forming the concavity 30 assures excellent productivity.

The invention is not limited to the embodiment described above with reference to the drawings. For example, the following embodiments are included in the technical scope of the invention. Sill other modifications can be made without departing from the spirit and scope of the present invention.

Each concavity can be formed to a depth of about the half of the thickness of the respective side plate. However, the range of the permissible depths of each concavity depends on the thickness of the respective side plate.

A concavity may be formed on only one of the left and right side plates. This construction is also included in the technical scope of the present invention.

The invention also is applicable to a female terminal fitting for use in a non-waterproof connector.

The mating male terminal fitting may be mounted on a connector to be directly coupled to piece of equipment. More particularly, the invention is widely applicable to the female terminal fittings having an approximately box-shaped connection portion to be connected with the tab of the mating male terminal fitting inserted into the connection portion from the front of the female terminal fitting.

What is claimed is:

1. A female terminal fitting having opposite front and rear ends, a substantially rectangular tubular connection portion being formed at the front end of the terminal fitting and having a ceiling plate, a bottom plate and opposed first and second side plates extending between the ceiling plate and the bottom plate, an elastic contact piece extending from ceiling plate and disposed in the tubular connection portion in opposed spaced relationship to the bottom plate, the elastic contact piece having a selected width, the tubular connection portion having an open front end for receiving a tab of a male terminal fitting along a tab-receiving direction of the connection portion and between the elastic contact piece and the bottom plate, the connection portion having opposite inner and outer surfaces, areas of said first and second side plates being thinned to define first and second concavities on said inner surface of said connection portion, each said concavity having an open front end at the front end of the connection portion and extending substantially parallel to the tab-receiving direction, portions of the side plates spaced from the concavities defining a width that exceeds the width of the elastic contact piece.

2. The terminal fitting of claim 1, wherein the concavities are substantially opposed to one another and substantially equally spaced from the bottom plate.

3. The terminal fitting of claim 1, wherein the connection portion has an external width measured between external surfaces of said side plates, the width being substantially constant at locations registered with the concavities and at locations offset from the concavities.

4. The terminal fitting of claim 1, wherein the concavity defines a depth of about 40% of the thickness of the material from which the connection portion is formed.

5. The terminal fitting of claim 1, wherein the terminal fitting is formed from a unitary piece of conductive metal.

6. The terminal fitting of claim 1, wherein each of said concavities defines a height measured in a direction extending between the ceiling plate and the bottom plate, the height of each said concavity being slightly greater than a thickness of the tab.

7. The terminal fitting of claim 1, wherein the concavities are aligned substantially symmetrical with a space defined between the elastic contact piece and the bottom plate.

* * * * *